United States Patent [19]

Dorr et al.

[11] Patent Number: 4,657,032

[45] Date of Patent: Apr. 14, 1987

[54] ASPIRATION DEVICE FOR A SMOKING ARTICLE

[76] Inventors: Robert T. Dorr, 1130 S. Avenida Conalea, Tucson, Ariz. 85748; David S. Alberts, 250 N. Indian House Rd., Tucson, Ariz. 85711

[21] Appl. No.: 791,533

[22] Filed: Oct. 25, 1985

[51] Int. Cl.[4] ..... A24D 3/00; A24D 3/04

[52] U.S. Cl. ..... 131/336; 131/342; 131/337; 131/173; 131/198.1; 128/202.21

[58] Field of Search ..... 131/335, 336, 337, 344, 131/198.1, 198.2, 339, 341, 342, 173; 128/202.13, 202.21

[56] References Cited

U.S. PATENT DOCUMENTS

| | | | |
|---|---|---|---|
| 659,542 | 10/1900 | McIntosh | 128/202.21 |
| 1,974,242 | 9/1934 | Jordan, Jr. et al. | 128/202.21 |
| 2,764,154 | 9/1956 | Murai | 128/202.21 |
| 3,339,558 | 9/1967 | Waterbury | 131/335 |
| 3,789,855 | 2/1974 | Norman | 131/198.2 |
| 4,195,645 | 4/1980 | Bradley, Jr. et al. | 131/337 |

*Primary Examiner*—V. Millin
*Assistant Examiner*—H. Macey
*Attorney, Agent, or Firm*—Marshall, O'Toole, Gerstein, Murray & Bicknell

[57] ABSTRACT

An aspiration device for delivering a controlled dosage of a drug to a smoker's mouth and lungs comprises an elongated container adapted to be positioned within a cigarette or other smoking article adjacent the end intended to be held in the smoker's mouth. The container holds a supply of a drug which is aspirated directly into the smoker's mouth as a result of the suction applied by the smoker to the end of the cigarette. An air inlet port commnicates with the outer surface of the cigarette and permits air to enter the container in response to the partial vacuum created by the applied suction. The drug held within the container is discharged through an exit orifice thereof which is coplanar with the end of the cigarette, so that mixing of the drug with the tobacco smoke occurs within the mouth of the smoker, at reduced temperature and lower smoke concentration. By appropriate selection of the size of the exit orifice from the container, the rate at which the drug is delivered can be controlled, so that an amount of drug proportional to the amount of smoke withdrawn from the cigarette or other smoking article can be delivered into the smoker's mouth.

8 Claims, 4 Drawing Figures

28
12
29
4
4

12
28
31
29
27
23

12
13
2
14
11
10
2

19
18
17
22
23
24
21
11
16
14
26
27

ASPIRATION DEVICE FOR A SMOKING ARTICLE

The present invention relates to an aspiration device for use with a smoking article such as a cigarette for causing the introduction of biologically active materials into the mouth and respiratory tract of a smoker, in proportion to the amount of smoke drawn through the smoking article.

BACKGROUND OF THE INVENTION

It is generally recognized that smoking, particularly cigarette smoking, is a prime cause of vascular disorders, lung and oral cancer, and cancer of the upper respiratory tract. It is known that tobacco smoke contains cancer-causing agents and that these agents are carried to the smoker's mouth and respiratory tract in the tobacco smoke. It is also known that certain biologically active or drug materials known as biological response modifiers (BRM), including retinoids (vitamin A and its natural and synthetic analogs), thymosin, the interferons, and others, have been shown to have the ability to prevent or modify carcinogen-induced animal and human cancers. These compounds have the ability not only to modify or inhibit the growth of existing cancers, but also to block the induction of cancer, i.e., to act as cancer chemopreventive agents. In addition, a potentially useful method of reducing harmful cigarette smoke inhalation involves the oral delivery of nicotine from a reduced-smoke or "smokeless" cigarette, thus satisfying the physiologic need for nicotine while preventing the ingestion of harmful smoking-related carcinogens and irritants. Furthermore, no general drug delivery system is presently available which can provide controlled dosages of orally-active drugs using cigarette smoking as the delivery medium.

In order to take advantage of the apparent cancer-preventive properties of vitamin A and its analogs, it has been proposed to provide cigarettes with a filter incorporating a supply of these materials. In U.S. Pat. No. 3,339,558, vitamin A is contained within a rupturable capsule which is ruptured by the smoker immediately prior to smoking. U.S. Pat. No. 3,525,582 shows a similar cigarette in which vitamin A is encapsulated in a heat rupturable capsule, which is ruptured by the heat of the burning tobacco. In U.S. Pat. No. 3,667,478, a stabilized form of vitamin A, capable of withstanding long periods of storage, is distributed throughout the filter, rather than being contained in a separate capsule. European Patent Application No. 0 003 064 A2 shows a similar cigarette in which certain synthetic vitamin A analogs are used as the biologic response modifier.

In all of the above-mentioned cigarettes, the vitamin A or other BRM or drug is deposited on the filter material (or the tobacco when no filter is used) adjacent the end of the cigarette held in the mouth of the smoker. During smoking, the drug is entrained within the concentrated stream of tobacco smoke passing through the cigarette and is carried into the mouth of the smoker. The drug is, therefore, exposed within the cigarette itself to the hot concentrated stream of smoke, creating the possibility of thermal degradation of the drug substance as well as adverse chemical reactions with the active ingredients of the tobacco smoke.

SUMMARY OF THE INVENTION

The above-noted deficiencies of the prior art, wherein a BRM or other drug incorporated within a cigarette is exposed to the hot concentrated stream of smoke before entering the smoker's mouth, are obviated by the aspiration device of the present invention, which provides an elongated container adapted to be positioned within a cigarette or other smoking article adjacent the end intended to be held in the smoker's mouth. The container holds a supply of an appropriate BRM or other drug which is aspirated directly into the smoker's mouth as a result of the suction applied by the smoker to the end of the cigarette. An air inlet port communicates with the outer surface of the cigarette and permits air to enter the container in response to the partial vacuum created by the applied suction. The drug held within the container is discharged through an exit orifice thereof which is coplanar with the end of the cigarette, so that mixing of the drug with the tobacco smoke occurs within the mouth of the smoker, at reduced temperature and lower smoke concentration. By appropriate selection of the size of the exit orifice from the container, the rate at which the drug is delivered can be controlled, so that an amount of drug proportional to the amount of smoke withdrawn from the cigarette or other smoking article can be delivered into the smoker's mouth.

DETAILED DESCRIPTION

Figures 1, 2, 3, 4:
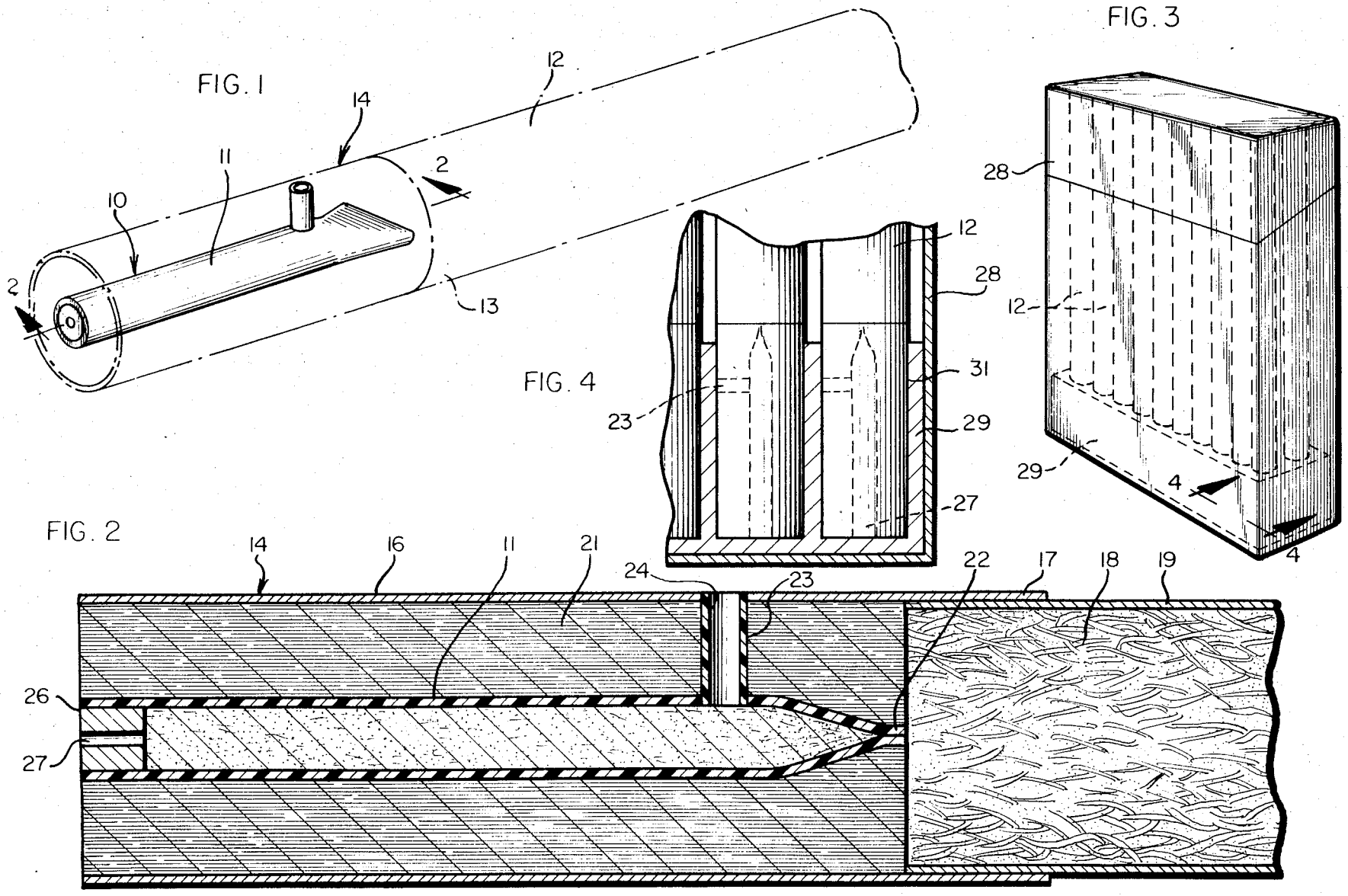
FIG. 1 is a perspective view of the end of a cigarette showing the aspiration device of the invention as it would typically be installed.
FIG. 2 is a section along the line 2—2 of FIG. 1 showing the location and interior construction of the BRM container of the device.
FIG. 3 is a perspective view of a box of cigarettes adapted for holding cigarettes incorporating the device of the invention.
FIG. 4 is a section along the line 4—4 of FIG. 3 showing the filter ends of the cigarettes within the container of FIG. 3.

In a preferred embodiment, the aspiration device 10 of the invention comprises an elongated container 11 having a hollow interior suitable for holding a supply of a BRM or other drug to be introduced into the mouth and respiratory tract of a smoker during the act of smoking. As shown in FIG. 1, aspiration device 10 is installed in cigarette 12 adjacent the end 13 intended to be inserted into the mouth of the smoker. Since most cigarettes are provided with filter tips incorporating a wide variety of filtering media, the device of the invention would most commonly be installed in a filter tip. It should be understood, however, that the presence of a filter is not a part of the present invention, which is equally suitable for use in cigarettes filled entirely with tobacco.

Aspiration device 10 is contained within an elongated housing 16 of filter tip 14 having an upstream end 17 attached to a conventional cylinder of tobacco 18 within a paper or similar wrapper 19. The available volume between container 11 and housing 16 is filled with a conventional filter packing 21, or alternatively with tobacco, as previously explained.

The upstream end 22 of container 11 is sealed, and adjacent the sealed end is an inlet port 23 having a bore 24, one end of which communicates with interior of container 11 and the other end of which penetrates the wall of housing 16 to permit the entry of air into the interior of container 11. The downstream end 26 of container 11, lying substantially in the same plane as the downstream end of filter tip 14, is provided with a restricted orifice 27, having an appropriate diameter for controlling the discharge of any liquid or particulate BRM or other drug contained within the interior of the container.

It will be seen that when a smoker draws on the end of a cigarette containing the device of the invention, a partial suction is created within the interior of the container 11, causing air to enter through inlet port 23 and to entrain the contents of the container for discharge through orifice 27 into the smoker's mouth and respiratory tract. By correlating the diameter of orifice 27 and the viscosity of a liquid drug composition, or the particle sizes of a particulate drug, the rate at which the drug is discharged under normal smoking conditions can be adjusted as desired.

The smoke of the burning cigarette passes through filter packing 21 directly to the exit end of the cigarette. The walls of container 11 serve to protect the drug contents from being heated by the hot stream of smoke as well as preventing direct contact with the smoke stream until both the drug and the smoke have exited the end of the cigarette.

The material of which container 11 is constructed is not critical. Any material can be used which is inert to the drug contents, resistant to the temperature to which it is exposed, and easily worked to the desired configuration. Plastic materials, such as polyethylene and polypropylene, are preferred, because of their low cost, inertness and ease of fabrication.

Since the drug contents of the aspiration device may be sensitive to contact with air or have a tendency to flow out of the device during storage, it is desirable to provide a closure for the filter end of a cigarette incorporating the device of the invention. Such a closure can consist of a plastic tape or cup (not shown) sealing both the open end of inlet port 23 as well as orifice 27.

A preferred form of commercial package for cigarettes incorporating the device of the invention, provided with means for sealing the inlet port and exit orifice thereof, is shown in FIGS. 3 and 4. FIG. 3 shows a conventional "flip-top" box 28 containing a supply of cigarettes 12 and a base 29 provided with cylindrical openings 31 into which the filter ends of the cigarettes are inserted. As shown in FIG. 4, the openings 31 in base 29 are dimensioned to form a close fit with the ends of the cigarettes, thereby blocking the inlet ports 23 and orifice 27 of each device against entry of air or leakage of the BRM contained therein.

The invention and its use are further illustrated in the following example.

EXAMPLE

Aspiration devices in accordance with the invention were constructed from polypropylene plastic tubing having an outer diameter of 2.5 mm, a length of 25 mm and a wall thickness of 0.5 mm. An inlet port 23 formed from an appropriate length (about 3 mm) of 1.5 mm outer diameter polypropylene tubing having an inner diameter of 1.0 mm. The end of container 11 adjacent the inlet port was sealed by crimping the tube end with a heated crimping tool. The volume of each device was 223 microliters. The opposite end of the device was partially closed by means of a plug having a length of about 2 mm and orifices ranging from 0.56 mm to 0.97 mm in diameter. Each device was placed within the filter section of a standard 100 mm cigarette with the open ends of the inlet port and the exit orifice flush with the filter wrapper and the mouth end of the filter respectively.

In a series of tests, each container was filled with vitamin A solution (Aquasol A Drops, Armour Pharmaceutical Co.) which had been mixed with varying proportions of water to adjust the viscosity and tested in a simulated smoking system in which sufficient suction was applied to the end of the cigarette to cause a air flow rate of 1 L/sec., a rate typical of actual smoking conditions. Two series of runs were performed, one with an exit orifice diameter of 0.71 mm in the aspiration device and a second series wherein the orifice had a diameter of 0.9 mm. The time required for complete emptying of the container was determined.

The results are summarized in Table I below.

TABLE I

DELIVERY RATES FOR VITAMIN A SOLUTION

| Composition of BRM | | | Exit | Time for | Delivery |
|---|---|---|---|---|---|
| Aquasol A (%) | Water (%) | Viscosity (cps) | Orifice Diameter (mm) | Complete Delivery* (sec.) | Rate (μL/sec.) |
| 100 | 0 | 31.1 | 0.71 | 10.4 | 2.2 |
| 75 | 25 | 10.6 | 0.71 | 6.3 | 3.7 |
| 50 | 50 | 4.56 | 0.71 | 2.9 | 7.7 |
| 25 | 75 | 1.67 | 0.71 | ~0.8 | ~29 |
| 100 | 0 | 31.1 | 0.9 | 3.8 | 6.1 |
| 75 | 25 | 10.6 | 0.9 | 1.9 | 12.3 |
| 50 | 50 | 4.56 | 0.9 | 1.3 | 17.6 |
| 25 | 75 | 1.67 | 0.9 | 0.5 | 46 |

*Completely filled (23 μL) tube exposed to air flow rate of 1.0 L/min; mean of 10 determinations.

From an inspection of Table I, it will be seen that at a constant degree of suction, the flow rate of the liquid BRM out of the dispensing device increased with a decrease in viscosity of the BRM solution, at a constant exit orifice diameter. The flow rate similarly increased with an increase in orifice diameter at a constant viscosity. It is therefore evident that by controlling these two variables (i.e., the viscosity of the liquid BRM solution, or the exit orifice diameter of the dispensing device), the rate at which the BRM is introduced into the mouth of the smoker can be controlled, and made proportional to the rate at which the cigarette is smoked.

In additional work with the above described aspiration device employing 100% Aquasol A drops, in which the device was exposed to sufficient suction to produce a flow of 1 L/sec. through the cigarette, exit orifice diameters below about 0.5 mm resulted in no flow of the BRM out of the container. With an orifice diameter of 0.71 mm, the contents of the device were delivered in 5 simulated puffs (exposure to suction) of 2 seconds duration each. The rate of delivery increased with increasing orifice size, until at an orifice diameter of about 1.0 mm, the entire contents of the device were delivered in one puff.

Similar control of the discharge rate from the device can be achieved using a particulate BRM having mean particle diameters appropriate for depositing the particulate material within a smoker's respiratory tract and lungs, i.e., ranging from less than 2 to more than 100 microns in diameter. The size of the outlet orifice diameter can be adjusted as necessary to control the rate at which the contents of the device of the invention are delivered when suction is applied to the end of the cigarette.

Although the device of the invention has been described with particular reference to use in a cigarette, it will be seen that its use is not so limited. The device can also be employed with cigars and other smoking articles. In addition, the aspiration device can be incorporated in a pipe, or a holder for cigarettes or cigars.

The foregoing detailed description has been given for clearness of understanding only, and no unnecessary limitations should be understood therefrom.

What is claimed is:

1. An aspiration device for a smoking article such as a cigarette comprising:

an elongated housing having an axial bore, said housing having an upstream end adapted to be attached to said smoking article and a downstream exit end through which smoke drawn by a smoker exits;

a hollow elongated container for a liquid or particulate material within said housing, said container having a sealed upstream end, a downstream exit end which is substantially coplanar with exit end of said housing, and an inlet port adjacent its sealed end, said inlet port penetrating said housing and permitting air to be drawn into said container by said smoker;

said exit end of said container having a restricted orifice through which said liquid or particulate material is discharged when suction is applied thereto by said smoker.

2. A device in accordance with claim 1 wherein any available volume within said housing not occupied by said container is filled with a filtration medium permeable to smoke.

3. A device in accordance with claim 1 containing a biologically active composition within said container.

4. A device in accordance with claim 3 wherein said composition is in liquid form.

5. A device in accordance with claim 4 wherein said composition is a solution of Vitamin A or nicotine.

6. A device in accordance with claim 3 wherein said composition is in particulate form.

7. A device in accordance with claim 6 wherein said composition is Vitamin A.

8. A device in accordance with claim 1 wherein said restricted orifice has a diameter of 0.5–1.0 mm.

* * * * *